US006705596B2

(12) United States Patent
Reinikka et al.

(10) Patent No.: US 6,705,596 B2
(45) Date of Patent: Mar. 16, 2004

(54) LIFTING APPARATUS AND FASTENER FOR MOTORCYCLE

(76) Inventors: Markus Reinikka, Nayttamonkatu 4 E 39, Tampere (FI), FIN-33720; Juho Keskinen, Mantykatu 4 A 3, Tampere (FI), FIN-33200; Arttu Kotilainen, Arkkitehdinkatu 26 B 18, Tampere (FI), FIN-33720

( * ) Notice: Subject to any disclaimer, the term of this patent is extended or adjusted under 35 U.S.C. 154(b) by 0 days.

(21) Appl. No.: 10/198,363

(22) Filed: Jul. 19, 2002

(65) Prior Publication Data

US 2003/0089896 A1 May 15, 2003

Related U.S. Application Data

(63) Continuation of application No. PCT/FI01/00040, filed on Jan. 18, 2001.

(30) Foreign Application Priority Data

Jan. 19, 2000 (FI) ..... 20000110

(51) Int. Cl.[7] ..... B66E 3/00

(52) U.S. Cl. ..... 254/134; 254/133 R; 254/134; 254/DIG. 4; 254/DIG. 16; 269/17; 269/296; 269/130; 269/131; 269/132

(58) Field of Search ..... 254/133 R, 134, 254/DIG. 4, DIG. 16; 269/17, 296, 130–132

(56) References Cited

U.S. PATENT DOCUMENTS

| | | | | |
|---|---|---|---|---|
| 3,778,087 A | | 12/1973 | Kallenbach | |
| 4,307,877 A | * | 12/1981 | Rogos | 269/296 |
| 4,311,473 A | | 1/1982 | Sugimoto | |
| 4,460,158 A | | 7/1984 | Chiesa et al. | |
| 4,607,823 A | * | 8/1986 | Thomas | 254/134 |
| 4,662,617 A | | 5/1987 | Ditterline, Jr. et al. | |
| 4,681,299 A | | 7/1987 | Siebert | |
| 5,139,233 A | * | 8/1992 | Goss | 254/134 |
| 5,211,376 A | | 5/1993 | Anderson | |
| 5,271,603 A | | 12/1993 | White | |
| 5,639,067 A | | 6/1997 | Johnson | |
| 5,769,397 A | | 6/1998 | Dhein | |

FOREIGN PATENT DOCUMENTS

| | | |
|---|---|---|
| DE | 19809259 | 5/1999 |
| FR | 1087818 | 3/1955 |

* cited by examiner

*Primary Examiner*—Robert C. Watson
(74) *Attorney, Agent, or Firm*—Oblon, Spivak, McClelland, Maier & Neustadt, P.C.

(57) ABSTRACT

A lifting apparatus for a motorcycle and a fastener. The lifting apparatus comprises a lifter and a fastener arranged in the lifter. The fastener comprises two supports located at a distance from each other whose upper end is provided with fastening elements for seizing footpegs/footboard of the motorcycle. The lifting apparatus further comprises at least one stabilizing member for preventing the motorcycle from tilting in a longitudinal direction.

14 Claims, 5 Drawing Sheets

LIFTING APPARATUS AND FASTENER FOR MOTORCYCLE

This application is a Continuation of International Application PCT/FI01/00040 filed Jan. 18, 2001 which designated the U.S. and was published under PCT Article 21(2) in English.

FIELD OF THE INVENTION

The invention relates to a lifting apparatus for a motorcycle, the lifting apparatus comprising a lifter and a fastener arranged in the lifter, the fastener comprising means for fastening the lifting apparatus to the motorcycle.

The invention further relates to a fastener for a motorcycle, the fastener comprising means for fastening a lifter to a motorcycle.

BACKGROUND OF THE INVENTION

Like other technical devices, two-wheeled motor vehicles, such as motorcycles, mopeds and scooters, need to be serviced and repaired from time to time. If the work must be carried out while a motorcycle rests on its wheels or a stand on the ground, the working position is rather difficult. Incessant bending causes physical strain and makes working slow, inconvenient and difficult as well. Furthermore, the motorcycle resting on its wheels cannot be freely disassembled. For instance the wheels and suspension cannot be detached. The problem remains unsolved by lifting tables disclosed in GB Publication 2 191 758 wherein a motorcycle is arranged, resting on its wheels, to stand on a ramp which can be lifted. Furthermore, lifting devices have been developed for motorcycle service work which are characterized in that the lifting device is placed underneath the frame. U.S. Pat. Nos. 5,639,067, 5,271,603 and 5,769,397 disclose such devices. The problem with these devices is, in turn, that the lower part of the frame of the motorcycle is not always free but in many motorcycle models the fairing extends to the lower part of the frame. In order to enable the lifting device to be used, the fairing should be removed before the lifting. This is, of course, difficult and slow. Besides the fairing, also the radiator, exhaust pipe and other components in the lower part of the frame may prevent the motorcycle from being lifted from underneath. There is also the danger of a carelessly arranged lifting device damaging e.g. wires, cables and tubes possibly being provided underneath the engine. In addition, the lifting device ing device supported underneath the frame is in the way of various service work. For instance emptying motor and transmission oil may be problematic.

BRIEF DESCRIPTION OF THE INVENTION

An object of the invention is to provide a lifting apparatus which enables a motorcycle to be safely and easily lifted to a desired height for service and repairs. A further object is to provide a fastener which enables various lifters to be fastened to a motorcycle irrespective of the construction of the motorcycle.

The lifting apparatus of the invention is characterized in that the fastener comprises at least two upwards pointing supports located at a distance from each other, the free ends of the supports are provided with fastening elements for fastening to footpegs/footboard of the motorcycle, and in that the lifting apparatus comprises at least one stabilizing member for preventing the motorcycle from tilting in a longitudinal direction.

Furthermore, the fastener of the invention is characterized in that the fastener comprises at least two upwards pointing supports located at a distance from each other and to be arranged in a vertically moving part of the lifter, and in that the free ends of said supports are provided with fastening elements for fastening to footpegs/footboard of the motorcycle.

The idea underlying the invention is that the lifting apparatus comprises a fastener for fastening a lifter to a motorcycle. The fastener comprises two upwards pointing supports located at a distance from each other to enable footpegs, or alternatively, depending on the structure of the motorcycle, a flat footrest, i.e. a footboard, of the motorcycle to be seized. When the motorcycle is lifted up, the supports receive the mass of the motorcycle and prevent the motorcycle from tilting in a transverse direction. The fastener further comprises at least one stabilizing member to enable the motorcycle to be stabilized such that it cannot turn around a pivot defined by the supports and provided transversely with respect to the motorcycle. The stabilizing member thus stabilizes the motorcycle, preventing it from tilting longitudinally. A further idea underlying the fastener of the invention is that the fastener can be fixedly attached to the lifter or an auxiliary device which can be arranged e.g. in a hydraulic jack and which comprises supports for seizing the footpegs/footboard.

A still further idea underlying an embodiment of the invention is that the distance between the supports can be changed.

The idea underlying an embodiment of the invention is that the fastener is turnably arranged in the lifter, which enables the fastener and the motorcycle attached thereto to be turned horizontally around the vertical axis of a hinge between the fastener and the lifter.

The idea underlying an embodiment of the invention is that at least two flexible belts tightened between a fastening element and the motorcycle are used as the stabilizing members.

An advantage of the invention is that the lifting apparatus is suited to motorcycles of different types. Thanks to the fastener of the invention, the lifting apparatus can also be used for lifting motorcycles wherein the fairing or another component prevents the motorcycle from being lifted from underneath the frame. Irrespective of the construction or design of the motorcycles, the footpegs/footboard is always freely exposed, which means that they can be freely seized by the fastening elements arranged in the supports. Thanks to the fastening principle of the invention, the underside of the engine remains accessible, which enables engine- and transmission-related servicing, such as oil changes, to be carried out without the lifting apparatus getting in the way. Furthermore, the lifting apparatus of the invention can be used as a mounting jig which enables the motorcycle to be disassembled/assembled uninterruptedly without having to lift it down every now and then in order to modify the fastening. This is possible when several, e.g. two, stiff stabilizing bars or stabilizing belts are used whose position can be changed one at a time as the work proceeds. Any motorcycle component can be detached from the frame and the motorcycle can be supported firmly although the mass centre may change due to the handling of the components. All in all, the lifting apparatus of the invention is quick, easy and safe to use. Furthermore, thanks to the simple structure, the purchase price of the lifting apparatus of the invention is relatively low, which means that in addition to repair shops and racing drivers, also ordinary motorists are able to buy one. The fastener enables also existing lifting apparatuses, such as standard car jacks, to be utilized in handling the motorcycle.

It is to be noted that in the present application, a motorcycle also refers to mopeds, scooters and other two-wheeled motor vehicles.

BRIEF DESCRIPTION OF THE DRAWINGS

The invention will be described in closer detail in the accompanying drawings, in which.

DETAILED DESCRIPTION OF THE INVENTION

Figure 1:
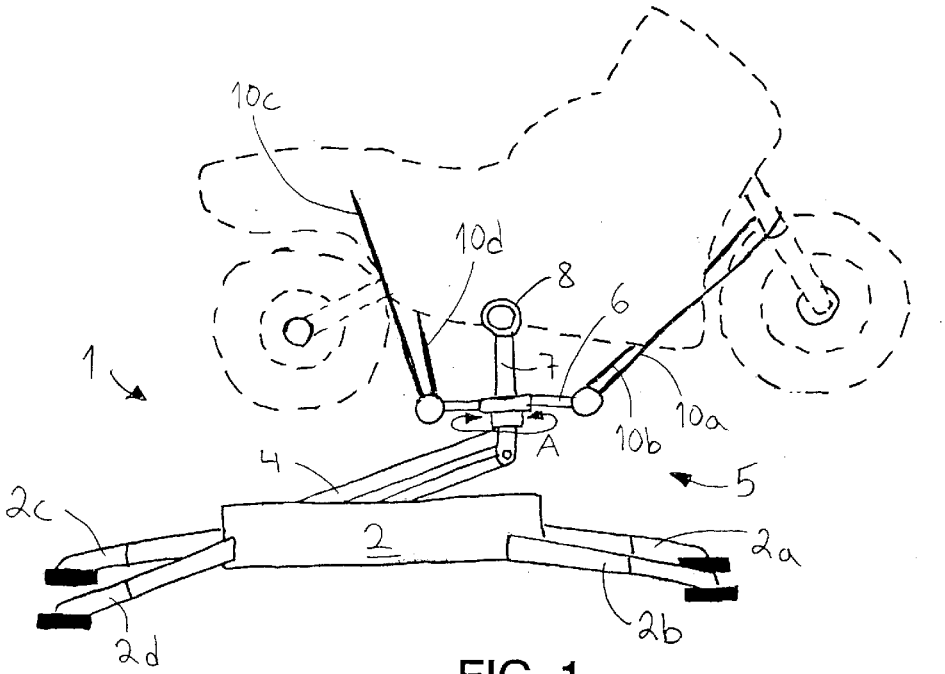
FIG. 1 is a schematic side view of a lifting apparatus of the invention in an operating situation and FIG. 2 is a perspective view of the same.
Figure 2:
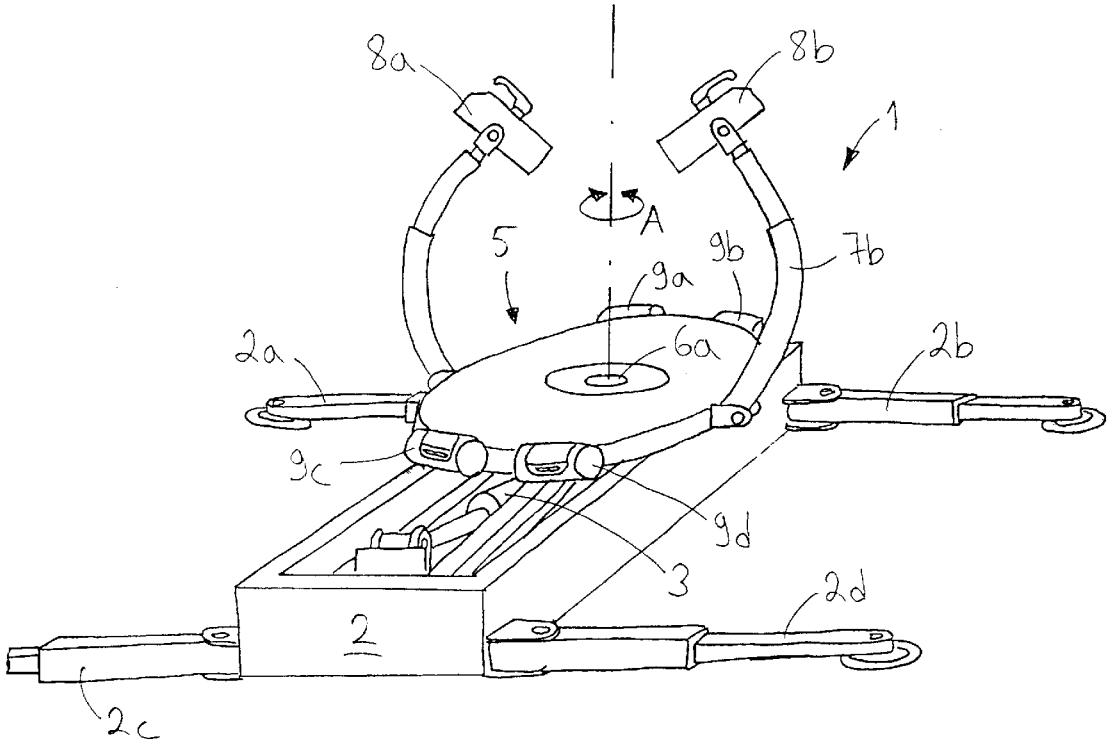

FIGS. 1 and 2 are simplified views of a lifting apparatus 1 of the invention used for lifting a motorcycle to a desired working height for service and repair operations. The lifting apparatus shown in the figure comprises a lifter 2, which is preferably a hydraulic lifter like a trolley jack; however, lifters with a different structure and operating principle are also feasible. For instance, a hydraulic bottle-shaped jack or a screw-operated articulated jack can thus be used as the lifter, as will become apparent later from FIGS. 3 and 6. The lifter is supported by supporting structures 2*a* to 2*d* to prevent the lifter from falling over during the lifting procedure. Furthermore, the lifter may comprise mechanical safety means to prevent the load from descending unintentionally. The lifter of the figure comprises a lift arm 4 moved by a hydraulic cylinder 3, a fastener 5 of the invention being arranged at the free end of the lift arm. The fastener 5 comprises a plate-like frame 6 supported against the lift arm 4 such that the frame retains its horizontal position irrespective of the movements of the lift arm. Furthermore, a pivot is provided between the fastener frame and the lift arm such that the fastener can be turned around a vertical axis in direction A, as shown in FIGS. 1 and 2. The pivot is illustrated by reference number 6*a* in FIG. 2. The fastener further comprises upwards pointing supports 7*a* and 7*b* arranged on the opposite sides of the frame 6 and a first end of the supports 7*a* and 7*b* is mounted turnably in the frame 6. A second end, i.e. the free end, of the supports 7*a* and 7*b* is provided with a fastening element 8*a* and 8*b*. The supports are attached to the footpegs of the motorcycle by means of the fastening elements.

After the lifting apparatus has been arranged underneath the motorcycle, the supports are turned into place with respect to their hinges such that the fastening elements are placed at the footpegs of the motorcycle. Next, the fastening elements are locked to the footpegs by a locking screw or the like in the fastening elements. Preferably, the length of the supports can be adjusted such that the lifting apparatus can be easily attached to motorcycles of different size and design. In addition, by adjusting the length of the supports, the size of a gap between the lifting apparatus and the frame of the motorcycle can be adjusted. The supports may comprise two tubes to be arranged within each other and, to make them easier to attach to the motorcycle, they may be bent as shown in the figure. By adjusting the mutual length of the supports, the motorcycle can also be lifted in a transversely inclined position. After the supports have been locked to the footpegs, the motorcycle is further supported against the fastener 5 by stabilizing members 10*a* to 10*d*. Since the footpegs are not necessarily located at the mass centre of the motorcycle, an additional support is usually needed. Two belt-like stabilizing members are provided both for the front and rear of the motorcycle, and they are tightened by accompanying tighteners. Belt reels 9*a* to 9*d*, in which the belt is stored, are arranged in the frame of the support. When the motorcycle is being fastened, a necessary amount of belt is unwound from the belt reel, which is then interlocked or it interlocks automatically e.g. as a seat belt in a car. When the belts are then unfastened from the motorcycle, they automatically rewind into the belt reels. Thanks to the belt reels, the stabilizing members stay in good order and they are easy to use. In addition to belts, other flexible banded elements, such as a rope, cable, chain, etc., may be used as the stabilizing members. The stabilizing belt is preferably made of a smooth material or it is coated with a suitable padding in order to prevent the fastening point from being damaged. The belt or such a flexible stabilizing member is easy to fasten to the motorcycle since it can be slipped through relatively small openings to a suitable fastening point and, on the other hand, it can be wound as a loop around relatively large structures. Also various quick-coupling parts, such as different loops and clips, may be used for fastening the belt. When several separate stabilizing members are used, the fastening point thereof in the motorcycle may be changed one by one. Consequently, the motorcycle does not have to be lifted down in the middle of the process but the stabilizing arrangement can be safely changed while the lifting apparatus is in an uplifted position. The sideways movement of the hinged supports shown in FIGS. 1 and 2 can be prevented by using suitable limiting elements when necessary.

Figure 3:
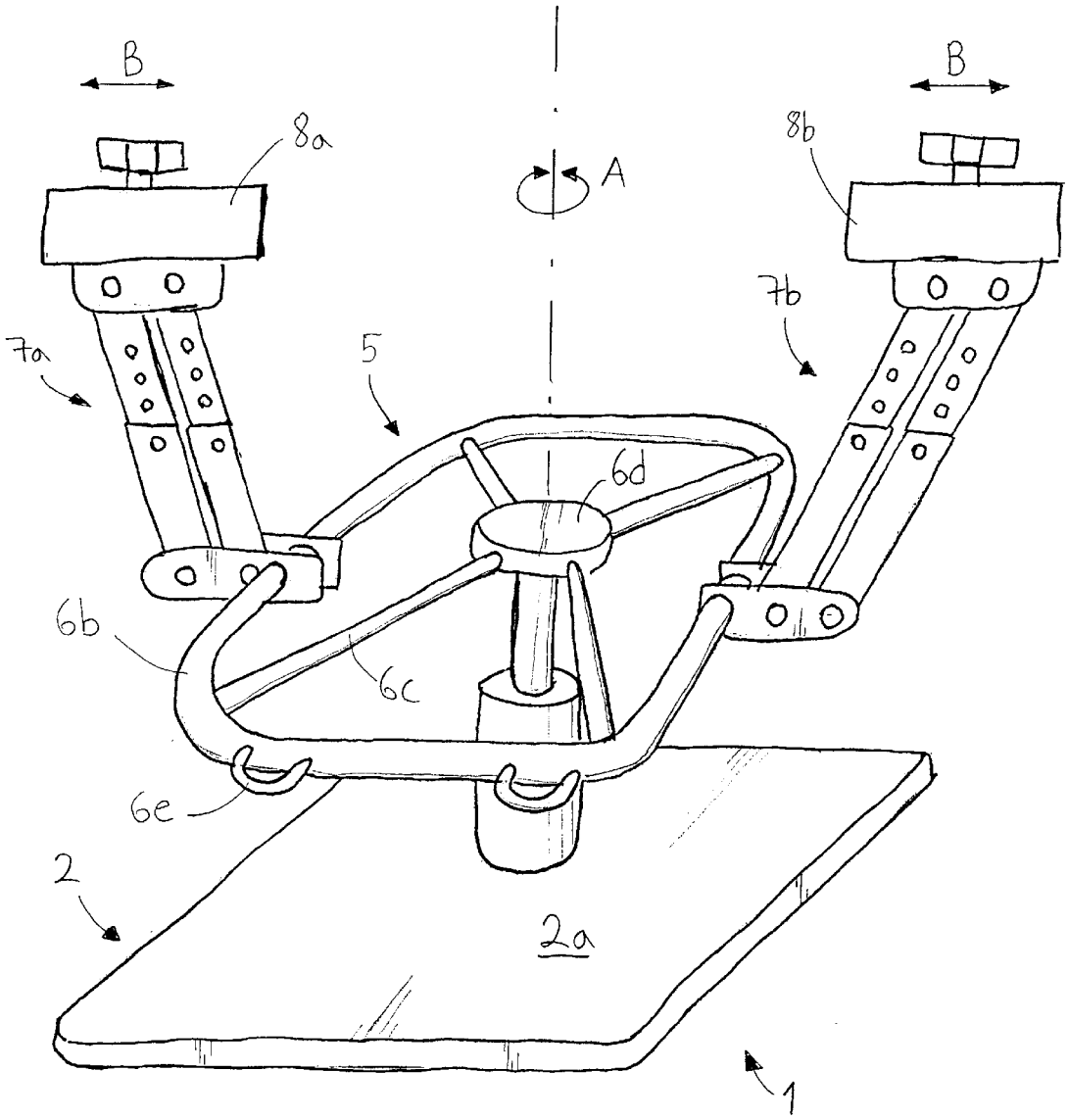
FIG. 3 is a schematic view of a second lifting apparatus according to the idea of the invention.

FIG. 3 shows the structure of a second lifting apparatus 1 of the invention. In this construction, a lifter 2 is a vertically arranged hydraulic cylinder resting on the ground by a supporting structure 2*a*. A fastener 5 of the invention is attached to the free end of the piston rod of the hydraulic cylinder. Preferably, the fastener can be rotated in direction A around the vertical axis designated by a dotted line. Supports 7*a* and 7*b* now constitute a parallel mechanism such that fastening elements 8*a* and 8*b* at the upper end of the supports retain their horizontal position irrespective of sideways B movement of the supports. As distinct from the previous figures, the frame of the fastener comprises bent tubes. The tubes form a periphery 6*b* of the frame connected by intermediate tubes 6*c* to a mounting point 6*d* at the end of the piston rod. For the stabilizing members, fixing loops 6*e* are arranged on the periphery 6*b* whereto the belts or the like can be fastened. In this case, the belts can be tied to the fixing loops and tightened e.g. by a ratched tightener known per se.

Figure 4:
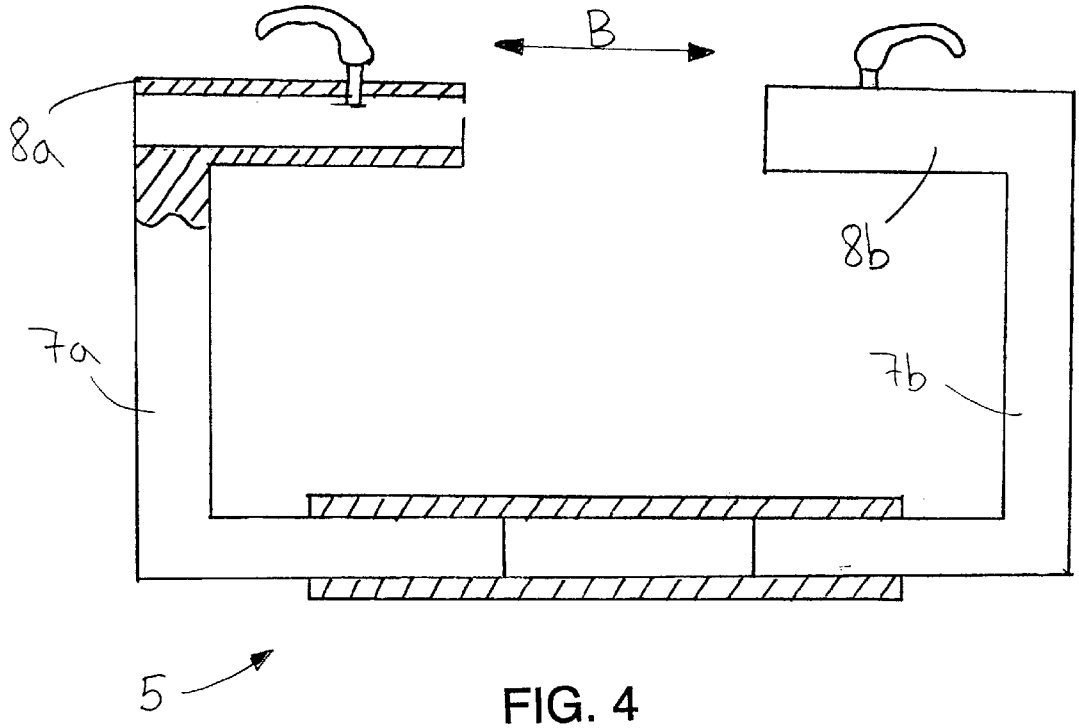
FIG. 4 is a schematic front view of a fastener of the invention and FIG. 5 is a similar view of the structure of a fastening element.
Figure 5:
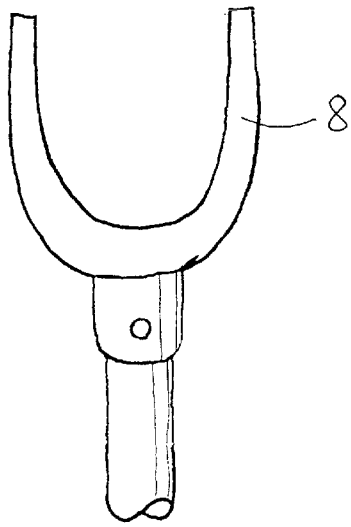

FIG. 4 is a partially sectional front view showing a fastener of the invention. Such a fastener can be arranged in a lifter available at a given time. The fastener can be equipped with different adapters to make the fastener easier to attach to the lifters. As distinct from the previous figures, the supports 7*a*, 7*b* are not turnably hinged but they are attached by their lower end to the frame 6 of the fastener such that they can be moved in direction B, which means that the distance between the supports can be changed according to the requirements of a single motorcycle. The frame of the fastener is provided with guiding surfaces along which the supports glide in transverse direction B. The side profile of the supports resembles the letter U. Fastening elements and locking parts are provided at the upper end of the supports. Furthermore, the fastening element 8 at the upper end of such supports may at its simplest be U-shaped in the manner shown in FIG. 5. No tightening screw or other locking part is necessary in this embodiment but the footpeg becomes automatically positioned in the U-shaped fastening element, thus enabling the motorcycle to be tilted in a longitudinal direction. It is also obvious that in lifters designed for a particular motorcycle model the supports may be attached fixedly at a predetermined distance from each other.

Figure 6:
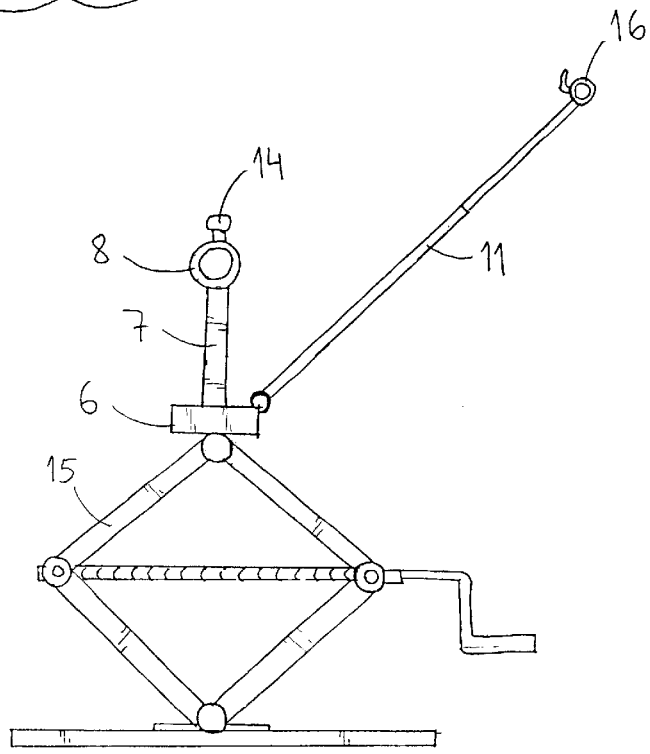
FIG. 6 is a schematic side view of the principle of a second fastener.

FIG. 6 shows a fastener attached to a screw-operated articulated jack 15. In the embodiment shown, the stabilizing member is a stiff bar 11 movably attached by its lower end to the frame 6 of the fastener, a fastening element 16 being provided at the other end of the bar for seizing the motorcycle. The position and length of the bar can be changed such that it can be attached to the most suitable fastening point in the motorcycle at a given time. Since the stiff bar, unlike the flexible belts or the like, is capable of receiving both compression loads and tensile loads, even one bar is enough to provide the motorcycle with stable support. By changing the length of the bar, the longitudinal tilting of the motorcycle can be adjusted. For changing the length, the bar may comprise e.g. a screw mechanism, which is quick to use e.g. by a motor-driven screw tightener.

Figure 7:
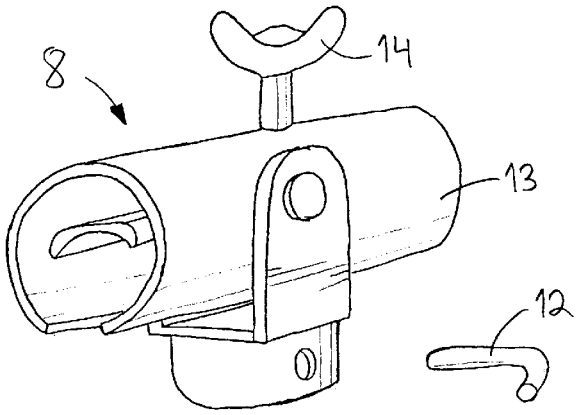
FIGS. 7 and 8 are schematic views of fastening elements of the fastener.
Figure 7:
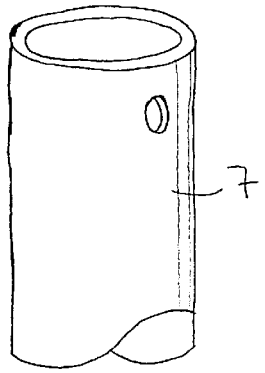

FIG. 7 shows a fastening element used in fastening motorcycles equipped with footpegs. The fastening element 8 comprises means, e.g. a locking pin 12, for being changeably attached to the upper end of a support 7. The upper end of the support may be provided with bayonet fasteners or other quick-coupling parts for attaching the fastening element. When e.g. the fastener of FIG. 3 is used wherein the supports are turnably hinged by their lower ends to the frame of the fastener, hinges are also provided between the upper end of the supports and the fastening element. The fastening element to be attached to the footpegs comprises a tubular frame 13 to be slid around the footpeg. Next, the fastening element is firmly tightened around the footpeg by a tightening screw 14. The tightening screw is arranged such that it is allowed to turn with respect to the fastening element along with the footpeg, in which case the fastening element does not receive the torsional moment caused by the longitudinal tilting of the motorcycle. The footpegs are then not subjected to excess torsional load owing to the fastening and, on the other hand, the longitudinal angle position of the motorcycle can be freely chosen by means of the stabilizing members.

Figure 8:
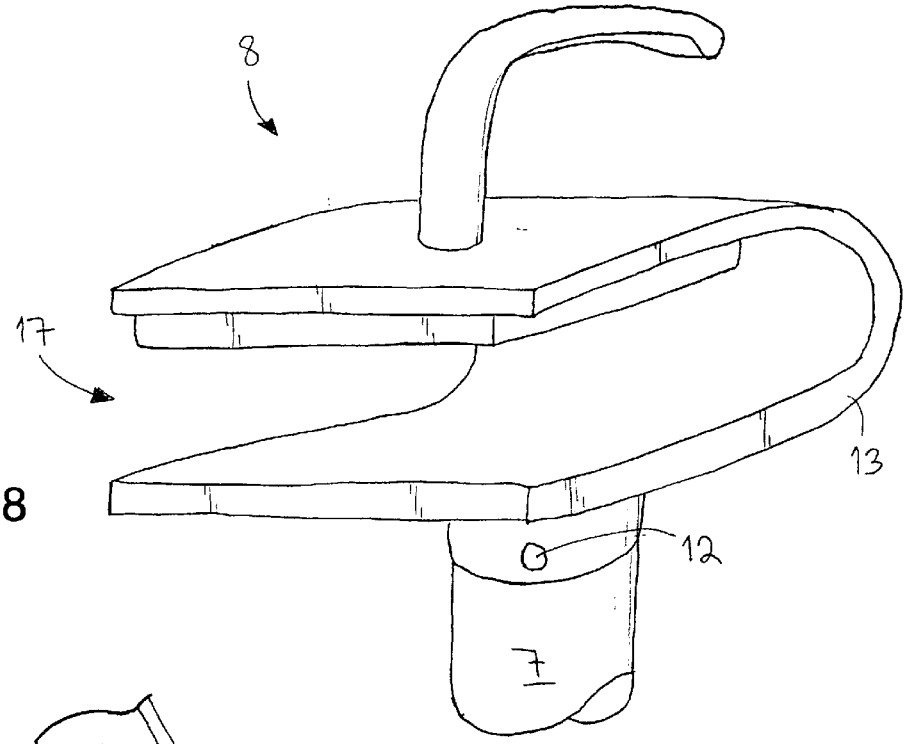

FIG. 8 shows a fastening element 8 used in conjunction with a motorcycle equipped with a footboard, such as a scooter. The fastening element comprises a U-shaped frame 13 which has been turned 90°, the edge of the footboard being arranged in an open slot 17 between the horizontal parts thereof and, if necessary, locked in place by means of a locking screw or the like of the fastening element. Furthermore, a hinge (not shown) is provided between the fastening element and a support to enable the motorcycle to tilt in a longitudinal direction. The fastening element is preferably changeably attached to the support 7 by the pin 12.

Figure 9:
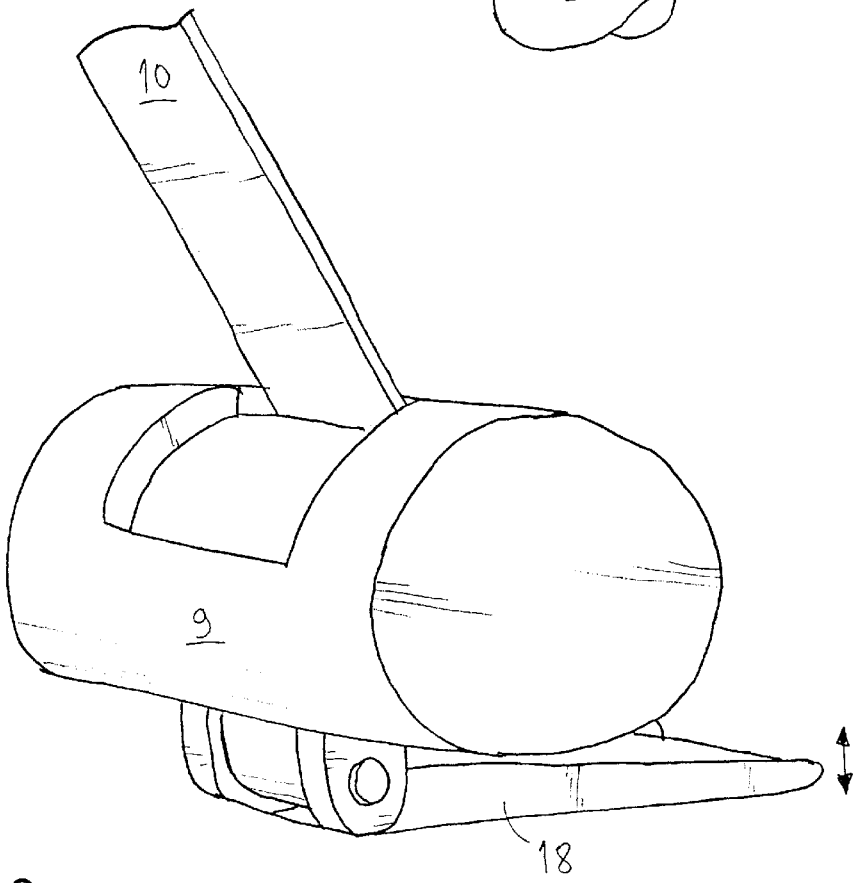
FIG. 9 is a schematic view of the construction of a stabilizing member.

FIG. 9 further shows a detail of the structure of a stabilizing member. Tightening means 18 are arranged in connection with a belt reel 9, which makes the belt quick to tighten and handle. The belt reel is usually arranged in connection with the frame 6 of the fastener but, if necessary, it may be arranged somewhere else in the lifting apparatus as well.

The drawings and the related description are only intended to illustrate the idea of the invention. In its details, the invention may vary within the scope of the claims. A common car jack, which may be e.g. a movable hydraulic trolley jack or a screw-operated articulated jack, may be used as the lifting apparatus. The advantage of using a trolley jack or the like is that if the support is sufficient, the motorcycle can be slightly transported in the uplifted position. A braking device is then preferably arranged in connection with the lifting apparatus to prevent the apparatus from moving unintentionally. In addition to car jacks, other lifting apparatuses, such as a fixed lifter arranged on the floor of a repair shop, may of course be used. Furthermore, it is feasible that the lifting apparatus is arranged directly in connection with the supports. In such a case, the fastener comprises no separate frame but the supports are arranged e.g. in an extension of the piston rod of a hydraulic cylinder. Furthermore, the fastener of the invention may be utilized in connection with various lifting apparatuses based on lever mechanisms.

What is claimed is:

1. A lifting apparatus for a motorcycle, the lifting apparatus comprising a lifter and a fastener arranged in the lifter, the fastener comprising:

at least two upwards pointing supports for receiving mass of the motorcycle, the supports being located at a distance from each other, fastening elements arranged in the free ends of the supports for fastening the lifting apparatus to footpegs of the motorcycle, and at least one stabilizing member for preventing the motorcycle from tilting in a longitudinal direction.

2. A lifting apparatus as claimed in claim 1, wherein the lifting apparatus comprises means for changing the distance between the supports in a transverse direction of the motorcycle.

3. A lifting apparatus as claimed in claim 1 wherein the fastener is pivotally mounted in the lifter, allowing the fastener to be rotated with respect to the vertical axis of the lifter.

4. A lifting apparatus as claimed in claim 1, wherein at least two belts are used as the stabilizing members.

5. A fastener for a motorcycle, the fastener comprising:

means for fastening the fastener in a vertically moving part of a lifter, at least two upwards pointing supports for receiving mass of the motorcycle, the supports being located at a distance from each other, fastening elements arranged in free ends of said supports for fastening to footpegs of the motorcycle, and wherein the fastening elements are arranged to allow the motorcycle to tilt in a longitudinal direction of the motorcycle.

6. A fastener as claimed in claim 5, wherein the fastener comprises means for adjusting the distance between the supports.

7. A fastener as claimed in claim 5, wherein the fastener comprises means for adjusting the length of the supports.

8. A fastener as claimed in claim 5, wherein the fastener comprises a frame in which the supports are arranged, and the frame of the fastener comprises a pivoting point allowing the fastener to be turned with respect to the vertical axis of said pivoting point.

9. A fastener as claimed in claim 5, wherein the fastener comprises at least one stabilizing member for stabilizing the motorcycle immovably with respect to the fastener.

10. A fastener as claimed in claim 5, wherein the fastening elements is a U-shaped piece.

11. A fastener as claimed in claim 5, wherein the fastening element is a tubular piece to be arranged around the footpeg.

12. A lifting apparatus for a motorcycle, the lifting apparatus comprising a lifter and a fastener arranged in the lifter, the fastener comprising:

at least two upwards pointing supports for receiving mass of the motorcycle, the supports being located at a distance from each other, fastening elements arranged in the free ends of the supports for fastening the lifting apparatus to footboard of the motorcycle, and at least one stabilizing member for preventing the motorcycle from titling in a longitudinal direction.

13. A fastener for a motorcycle, the fastener comprising:

means for fastening the fastener in a vertically moving part of a lifter, at least two upwards pointing supports for receiving mass of the motorcycle, the supports being located at a distance from each other, fastening elements arranged in free ends of said supports for fastening to footboard of the motorcycle, and wherein the fastening elements are arranged to allow the motorcycle to tilt in a longitudinal direction of the motorcycle.

14. A fastener as claimed in claim 13, wherein the fastening element has U-shaped frame being turned 90° and comprising an open slot for receiving an edge of the footboard.

* * * * *